US006302460B1

(12) United States Patent
Carr

(10) Patent No.: US 6,302,460 B1
(45) Date of Patent: Oct. 16, 2001

(54) SPORTS BALL RETRIEVAL AND STORAGE DEVICE HAVING MOLDED ONE-PIECE TAPERED RECEPTACLE WITH PIVOTAL LID AND SUPPORT MEMBERS

(75) Inventor: Ronald H. Carr, Plum Boro, PA (US)

(73) Assignee: Ferrari Importing Co., Pittsburgh, PA (US)

( * ) Notice: Subject to any disclaimer, the term of this patent is extended or adjusted under 35 U.S.C. 154(b) by 0 days.

(21) Appl. No.: 09/350,761

(22) Filed: Jul. 9, 1999

Related U.S. Application Data

(60) Provisional application No. 60/092,173, filed on Jul. 9, 1998.

(51) Int. Cl.[7] ..... A63B 47/02

(52) U.S. Cl. ..... 294/19.2; 206/315.9

(58) Field of Search ..... 294/19.2; 280/47.18, 280/47.315, 47.36, 655, 655.1; 221/185; 206/315.9; 248/129; 414/437, 439, 440; 56/328.1; 473/460

(56) References Cited

U.S. PATENT DOCUMENTS

| | | | | |
|---|---|---|---|---|
| 3,820,836 | * | 6/1974 | Seewagen et al. | 294/19.2 |
| 4,412,697 | * | 11/1983 | Verde | 294/19.2 |
| 4,811,980 | * | 3/1989 | Ferrari et al. | 294/19.2 |
| 5,294,161 | * | 3/1994 | Stap | 294/19.2 |
| 5,464,262 | * | 11/1995 | Madrazo | 294/19.2 |
| 5,549,215 | * | 8/1996 | Cruce et al. | 220/676 |

FOREIGN PATENT DOCUMENTS

| | | | | |
|---|---|---|---|---|
| 3000-004 | * | 7/1981 | (DE) | 294/19.2 |
| 3826-923 | * | 2/1990 | (DE) | 294/19.2 |

* cited by examiner

*Primary Examiner*—Dean J. Kramer
(74) *Attorney, Agent, or Firm*—Michael R. Swartz; John R. Flanagan

(57) ABSTRACT

A sports ball retrieval and storage device includes a receptacle, a pair of support members and a lid. The receptacle is in the form of a molded one-piece body made of substantially rigid material and having a plurality of side walls and a bottom grate integrally connected together so as to define an open top and an interior chamber of the receptacle. The side walls and bottom grate are formed of respective upper and lower annular perimeter members and laterally spaced apart elongated members extending between and integrally connected at opposite ends with opposite portions of the upper and lower annular perimeter members. The side walls converge toward one another from the open top to the bottom grate of the receptacle and thereby provide the molded one-piece body of the receptacle with a tapered configuration permitting receptacles of multiple devices to nest with one another. The elongated members of the bottom grate are spaced apart at a distance slightly less than the diameter of a tennis ball so as to define at least one opening therebetween through which a compressed tennis ball can forced into the interior chamber. The support members are pivotally mounted to the receptacle and convertible relative thereto between stand and handle positions. The lid is mounted to the receptacle for opening and closing the open top thereof.

15 Claims, 6 Drawing Sheets

SPORTS BALL RETRIEVAL AND STORAGE DEVICE HAVING MOLDED ONE-PIECE TAPERED RECEPTACLE WITH PIVOTAL LID AND SUPPORT MEMBERS

This patent application claims the benefit of U.S. provisional application No. 60/092,173, filed Jul. 9, 1998.

BACKGROUND OF THE INVENTION

1. Field of the Invention

The present invention generally relates to retrieving and storing sports balls and, more particularly, is concerned with a sports ball retrieval and storage device having a molded one-piece tapered receptacle and pivotal lid and support members on the receptacle.

2. Description of the Prior Art

There have been numerous sports ball retrieval and storage devices introduced in the art over the years. These devices basically include a receptacle with a handle, and with or without a lid. The receptacle is formed by a plurality of interconnected side walls and a grate connected across the bottom of the side walls. The handle is attached to one or more of the side walls of the receptacle. The lid may be mounted to the top of one of the sidewalls and pivotally movable to open and close the receptacle. The bottom grate and side walls of the receptacle as well as the handle and lid are commonly made of a plurality of rigid wire-like bars. In addition, the rigid bars of the bottom grate are laterally spaced apart a distance slightly less than the diameter of a tennis ball so that when the device is placed over the tennis ball and pressed down on top of the ball, the tennis ball is compressed between the bars and forced into the receptacle.

Representative examples of such prior art ball retrieval and storage devices are disclosed in U.S. Pat. No. 698,226 to Roberts, U.S. Pat. No. 3,371,950 to Stap, U.S. Pat. No. 3,820,836 to Seewagen et al., U.S. Pat. No. 3,889,996 to Campbell, U.S. Pat. No. 3,984,138 to Brunner et al., U.S. Pat. No. 4,412,697 to Verde, and U.S. Pat. No. 4,461,504 to Perez et al. The devices of the Seewagen et al., Campbell, Brunner et al., Verde and Perez et al. patents show a receptacle and handle with the receptacle having side walls and a bottom grate formed by a plurality of rigid formed and welded wire-like bars. However, formed and welded wire-like bars are costly to produce and their use results in a relatively heavy device.

To overcome the aforementioned constructional drawbacks of receptacles and handles with wire-like bars of previous prior art ball retrieval and storage devices, receptacles have been made of parts formed of a rigid molded plastic material. U.S. Pat. No. 5,294,161 to Stap, U.S. Pat. No. 5,664,672 to Niksich and U.S. Des. Pat. No. 347,670 to Stap are representative of such devices. While not as heavy as devices formed of wire-like bars, these devices require the formation of numerous parts which have to be assembled by either the manufacturer, which increases production costs, or the consumer, which is less convenient.

Consequently, a need still exists for a ball retrieval and storage device which provides a more effective and comprehensive solution to the aforementioned problems of the prior art devices without introducing any new problems in place thereof.

SUMMARY OF THE INVENTION

The present invention provides a sports ball retrieval and storage device designed to satisfy the aforementioned need.

The sports ball retrieval and storage device of the present invention has a receptacle in the form of a molded one-piece body made of plastic material and being lighter and less expensive to manufacture than the multi-part receptacles of prior art devices. The one-piece molded body of the receptacle has side walls in a tapered configuration extending from an open top to a bottom grate of the receptacle such that the receptacles of a plurality of the devices are nestable with one another for efficient bulk packaging, storage and shipment of the devices. The device also has a pair of support members convertable between stand and handle positions and thus capable of performing dual functions which minimizes the number of parts employed by the device.

Accordingly, the present invention is directed to a sports ball retrieval and storage device which comprises: (a) a receptacle in the form of a molded one-piece body made of a rigid material and having a plurality of side walls and a bottom grate integrally connected together so as to define an open top and an interior chamber of the receptacle; (b) the side walls and bottom grate of the molded one-piece body being formed by respective upper and lower annular perimeter members and laterally spaced apart elongated members extending between and integrally connected at opposite ends with opposite portions of the annular perimeter members; (c) the side walls converging toward one another from the open top to the bottom grate of the receptacle and thereby providing the molded one-piece body of the receptacle with a tapered configuration permitting receptacles of multiple devices to nest with one another; (d) the elongated members of the bottom grate being spaced apart at a distance slightly less than the diameter of a tennis ball so as to define at least one opening therebetween through which a compressed tennis ball can be forced into the interior chamber of the receptacle.

The retrieval and storage device also includes a pair of support members convertible between stand and handle positions. The support members are each separately pivotally and releasably mounted to one of the side walls of an opposite pair of the side walls of the receptacle. More particularly, the support members in the handle position extend substantially above the receptacle to ends of the support members disposed adjacent to one another for a user to hold in manually transporting the device whereas the support members in the stand position extend substantially below the receptacle to the ends thereof disposed remote from one another for resting on a support surface to support the receptacle at an elevated position above the surface. Each support member has an inner portion and an outer portion. The outer portion is angularly displaced from the inner portion such that the outer portions of the support members converge toward one another when the support members are in the handle position whereas the outer portions of the support members diverge from one another when the support members are in the stand position. The inner portion of each support member has opposing end sections.

The receptacle further includes means for pivotally mounting each support member to one of the side walls of the opposite pair of the side walls of the receptacle. The pivotal mounting means is in the form of a pair of projections each being integrally formed as part of the molded one-piece body of the receptacle and thus integrally attached on the one of the side walls of the opposite pair of the side walls of the receptacle. Each projection has opposite ends and defines a bore open at the opposite ends. The bore of each projection is adapted to receive and retain therein the opposing end sections of the inner portion of one of the support members such that the opposing end sections of the inner portion of the one support member can rotate within the bore upon movement of the one support member between the handle and stand positions.

The receptacle further includes upper means for securing each support member in the handle position. The upper securing means is in the form of two pairs of laterally spaced apart upper projections with each pair being integrally formed as part of the molded one-piece body of the receptacle and thus integrally attached on one of the side walls of the opposite pair of the side walls of the receptacle. Each upper projection has opposite ends and defines a recess open lengthwise and at the opposite ends for receiving and releasably retaining therein a section of the inner portion of one of the support members when the one support member is in the handle position.

The receptacle further includes lower means for securing each support member in the stand position. The lower securing means is in the form of two pairs of laterally spaced apart lower projections with each pair being integrally formed as part of the molded one-piece body of the receptacle and thus integrally attached on one of the side walls of the opposite pair of the side walls of the receptacle and spaced from and disposed below the upper securing means. Each lower projection has opposite ends and defines a recess open lengthwise and at the opposite ends for receiving and releasably retaining therein a section of the inner portion of one of the support members when the one support member is in the stand position.

The retrieval and storage device further includes a lid for opening and closing the open top of the receptacle. The lid is in the form of a molded one-piece part made of plastic material and having an outer annular perimeter member and laterally spaced apart elongated members extending between and integrally connected at opposite ends with opposite portions of the outer annular perimeter member. The lid further has integrally formed thereon at the opposite portions of the outer annular perimeter member thereof means for engaging the upper annular perimeter member of the receptacle. The engaging means comprises a pair of laterally spaced apart first tabs integrally attached on and extending outwardly from one of the opposite portions of the outer annular perimeter member of the lid, a second tab integrally attached on and extending outwardly from the other of the opposite portions of the outer annular perimeter member of lid, and a plurality of projections each integrally formed on one of the first and second tabs. Each projection has a pair of opposite ends and a lengthwise open recess extending between the opposite ends for receiving and releasably retaining therein a respective portion of the upper annular perimeter member of the receptacle such that the lid at the projections of the first tabs thereon can rotate on the open top of the receptacle when the projection of the second tab of the lid is detached from the open top of the receptacle. Thus, the lid is removably and pivotally mounted to the upper annular perimeter member of the receptacle and can move between an open position and a closed position relative to the open top of the receptacle. The lid in the open position is disposed away and hangs down from the open top of the receptacle whereas the lid in the closed position is disposed across the open top of the receptacle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
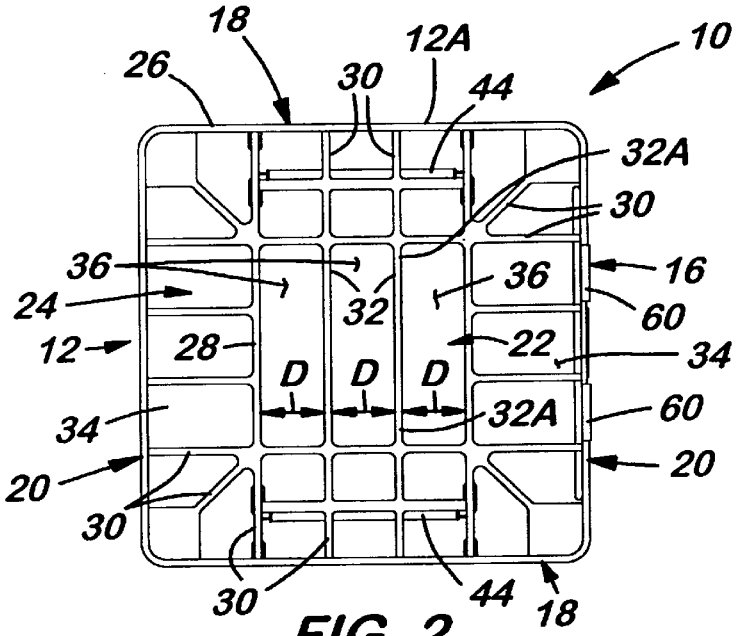
FIG. 2 is a top plan view of the retrieval and storage device as seen along line 2—2 of FIG. 1.

In the following description, like reference characters designate like or corresponding parts throughout the several views. Also, in the following description, it is understood that terms such as "forward", "rearward", "left", "right", "upwardly", "downwardly", and the like, are words of convenience and are not construed to be limiting terms.

Referring to the drawings and particularly to FIGS. 1 to 5, there is illustrated a sports ball, such as a tennis ball, retrieval and storage device, generally designated 10, of the present invention. Basically, the retrieval and storage device 10 includes a receptacle 12, a pair of support members 14 and a lid 16. The support members 14 are pivotally mounted to the receptacle 12 and convertible relative thereto between stand and handle positions, as seen respectively in FIGS. 3 and 5. The lid 16 is mounted to the receptacle 12 for opening and closing an open top 12A of the receptacle 12.

Referring to FIGS. 1 to 8, the receptacle 12 of the device 10 is in the form of a molded one-piece body made of substantially rigid material and having a pair of first side walls 18 opposite from one another, a pair of second side walls 20 opposite from one another and a bottom grate 22, all of which are integrally connected together so as to define the open top 12A on the receptacle 12 and an interior chamber 24 in the receptacle 12. The rigid material of the receptacle 12 can be a resilient plastic or a composite of any combination of graphite, fiberglass reinforced nylon, polypropylene, PVC, ABS or polycarbonate. The receptacle 12 can be fabricated using a suitable conventional molding technique.

The pairs of first and second side walls 18,20 and the bottom grate 22 are formed by respective upper and lower annular perimeter members 26, 28 and laterally spaced apart elongated members 30, 32 extending between and integrally and rigidly connected at opposite ends 30A, 32A with opposite portions of the upper and lower annular perimeter members 26, 28. The pair of opposite first side walls 18 are substantially identical to one another as are the pair of opposite second side walls 20 substantially identical to one another. The upper and lower annular perimeter members 26,28 are endless and substantially rectangular in shape with the upper annular perimeter member 26 having a circumference substantially larger than the lower annular perimeter member 28 such that the pairs of first and second side walls 18, 20 have generally trapezoidal shapes and converge toward one another from the open top 12A (as defined by the upper annular perimeter member 26) to the bottom grate 22 and, more particularly, to the lower annular perimeter member 28 located at the connection of the side walls 18, 20 with the bottom grate 22 of the receptacle 12. Thereby, the molded one-piece body of the receptacle 12 is provided with a tapered configuration permitting the receptacles of multiple devices to nest with one another. The elongated members 30 of the pairs of first and second side walls 18, 20 extend vertically between and interconnect the upper and lower annular perimeter members 26, 28 and define a plurality of openings 34 therebetween. The openings 34 give each of the first and second side walls 18, 20 a grate-like appearance.

Figure 8:
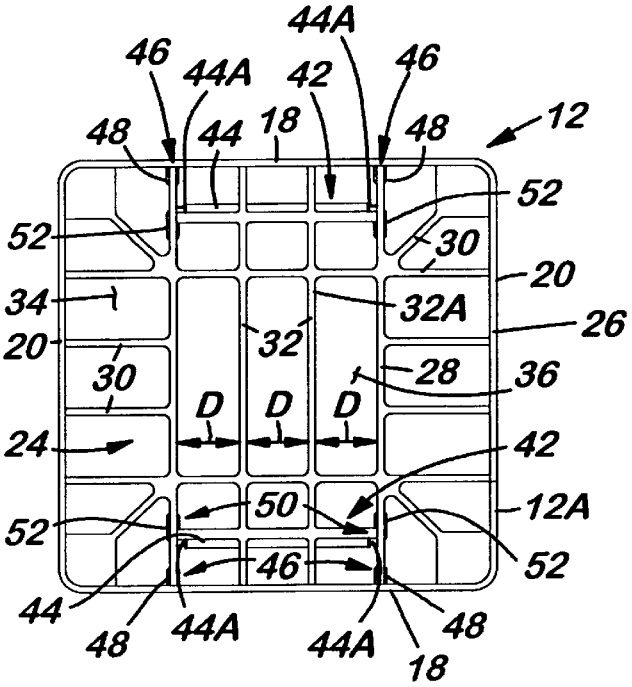
FIG. 8 is a top plan view of the receptacle as seen along line 8—8 of FIG. 6.
Figure 11:
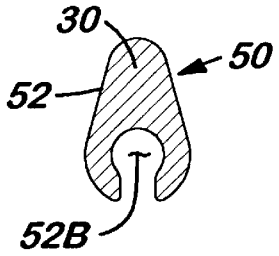
FIG. 11 is an enlarged transverse sectional view of a representative one of a plurality of projections on the receptacle as taken along line 11—11 of FIG. 7 for releasably securing one of the support members of the device in the handle and stand positions.
Figure 6:
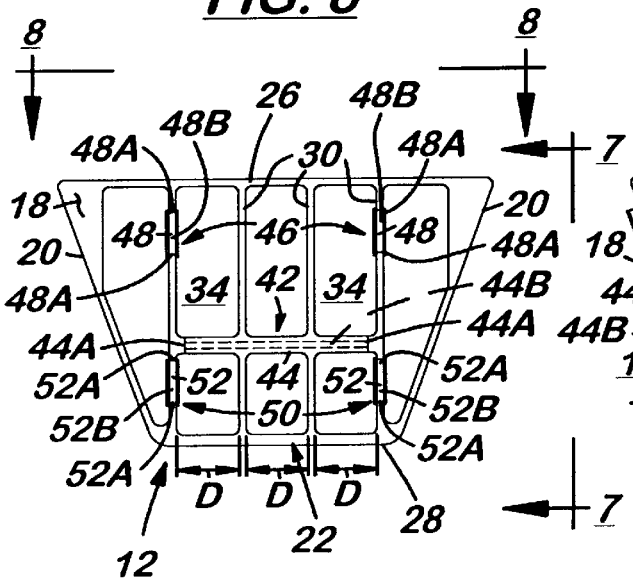
FIG. 6 is an enlarged side elevational view of the receptacle of the retrieval and storage device of FIG. 1.
Figure 7:
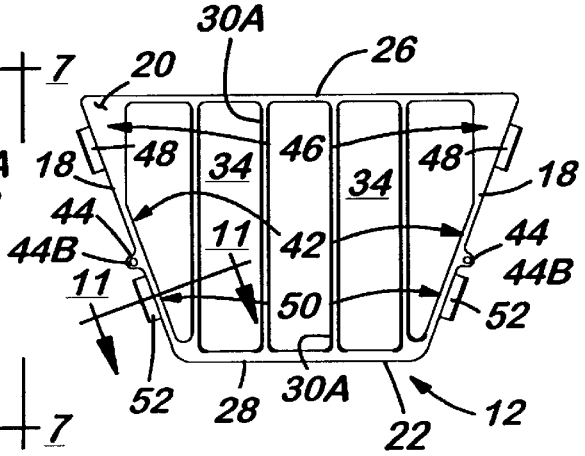
FIG. 7 is another side elevational view of the receptacle as seen along line 7—7 of FIG. 6 in which the receptacle is rotated ninety degrees from the position in FIG. 6.
Figure 9:
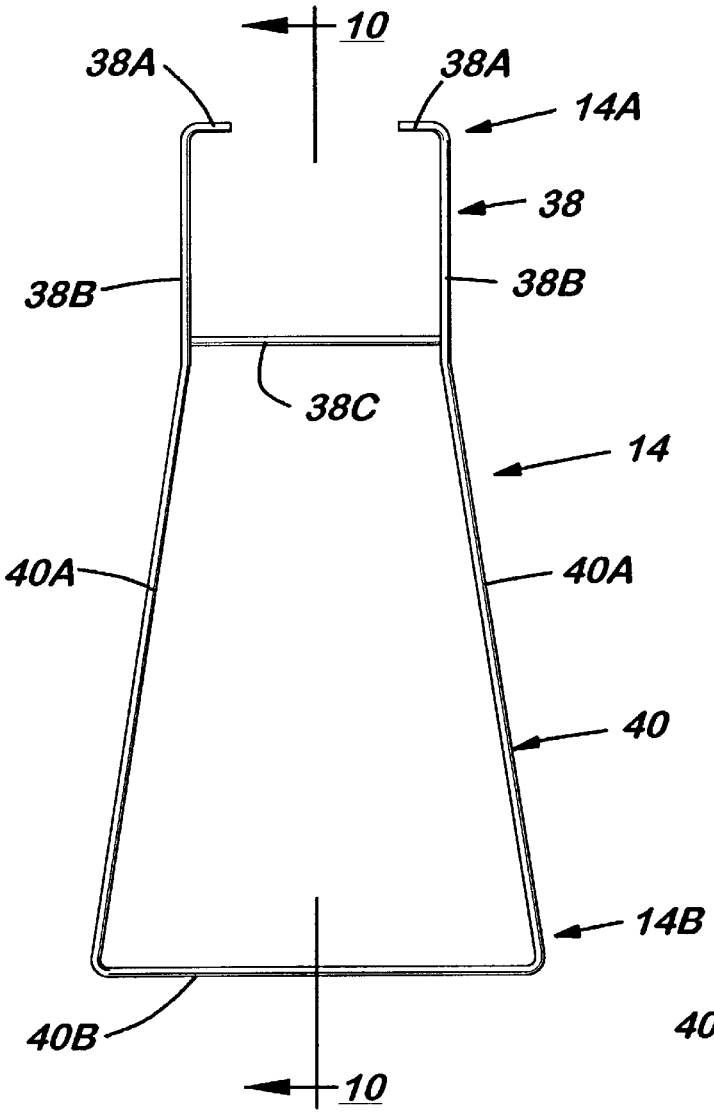
FIG. 9 is an enlarged front elevational view of one of the support members of the retrieval and storage device of FIG. 1.
Figure 10:
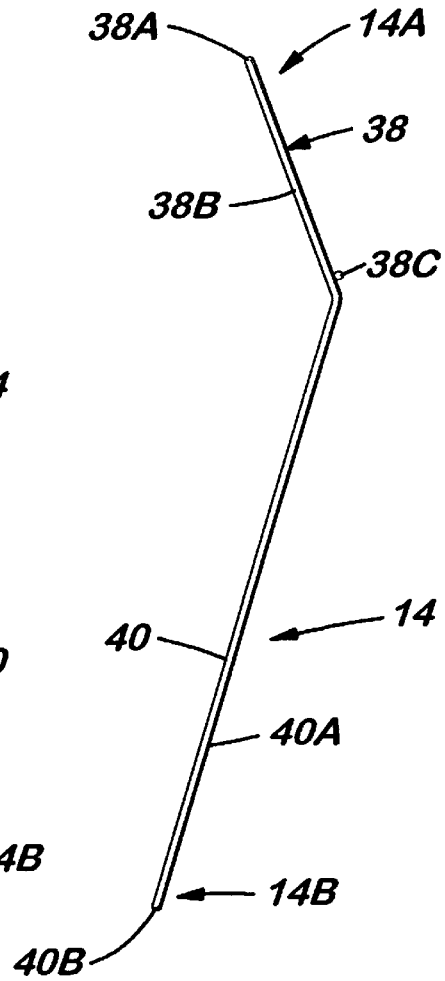
FIG. 10 is a vertical sectional view of the support member taken along line 10—10 of FIG. 9.
Figure 15:
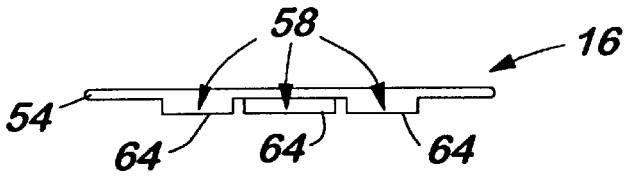
FIG. 15 is an end elevational view of the lid as seen along line 15—15 of FIG. 13.
Figure 13:
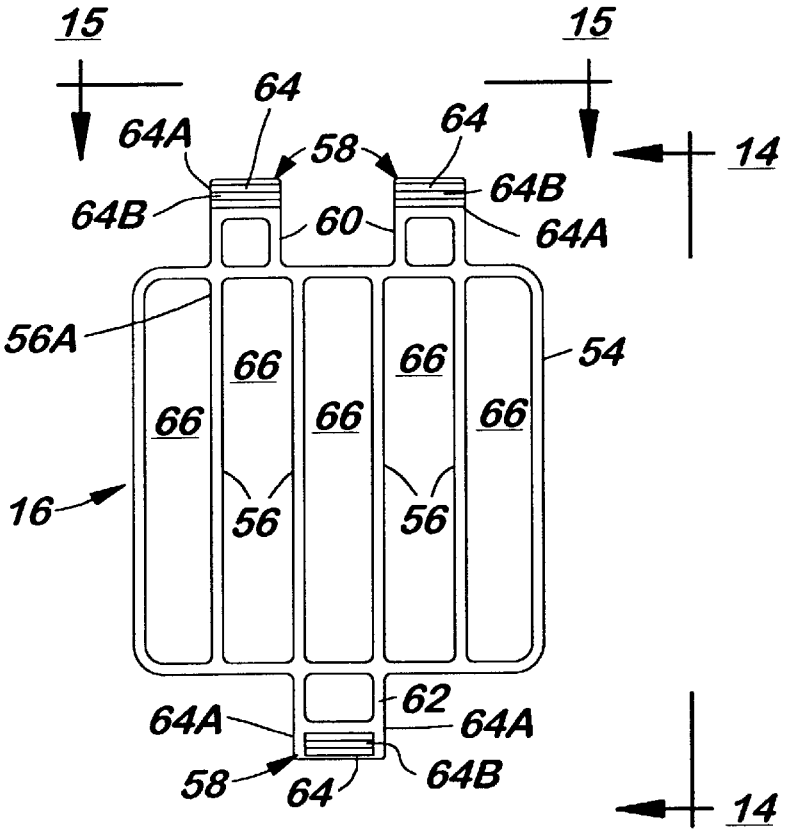
FIG. 13 is an enlarged bottom plan view of the lid of the retrieval and storage device.
Figure 14:
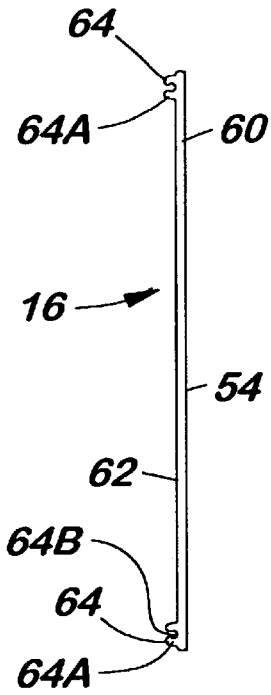
FIG. 14 is a side elevational view of the lid as seen along line 14—14 of FIG. 13.

Referring to FIGS. 2 and 8, the bottom grate 22 of the receptacle 12 has a substantially rectangular configuration as defined by the lower annular perimeter member 28 of the receptacle 12. The elongated members 32 of the bottom grate 22 extend generally parallel to one another between and interconnect opposite portions of the lower annular perimeter member 28. The elongated members 32 of the bottom grate 22 also are spaced apart at a distance D, as seen in FIGS. 2 and 8, being slightly less than the diameter of a tennis ball so as to define at least one and preferably a plurality of openings 36 therebetween through which a compressed tennis ball can be forced in a known manner into the interior chamber 24 of the receptacle 12 but through which an uncompressed tennis ball cannot pass. The openings 34 of the pairs of first and second side walls 18, 20 together with the openings 36 of the bottom grate 22 reduce the amount of material used to form the receptacle 12 and thereby reduce the weight thereof.

Figure 1:
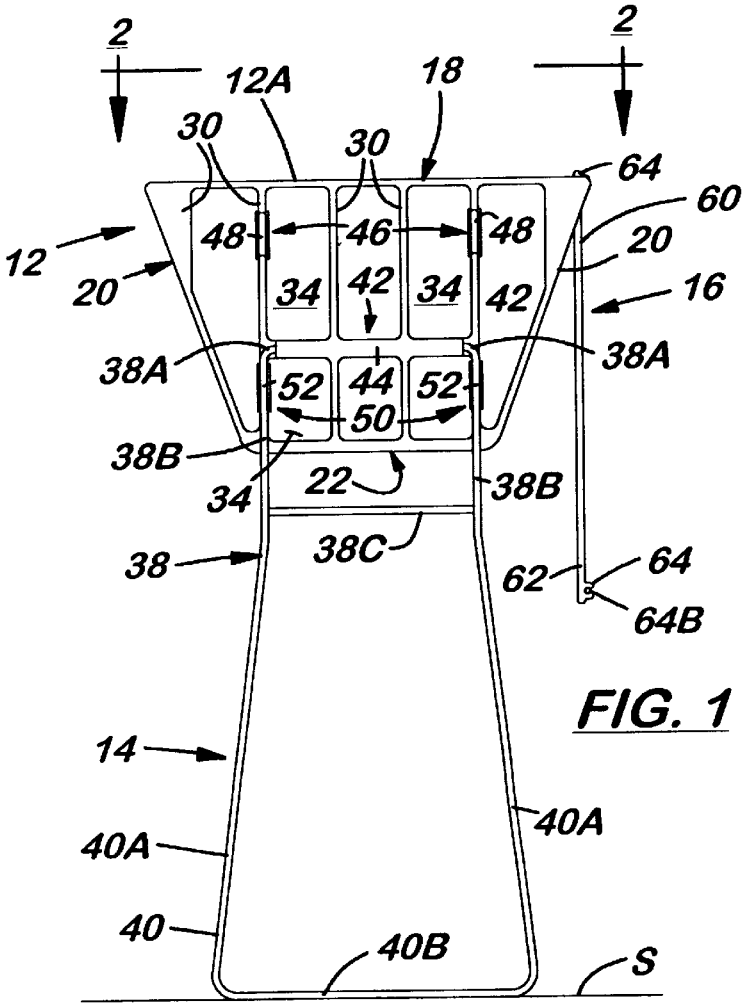
FIG. 1 is a side elevational view of a sports ball retrieval and storage device of the present invention showing support members mounted to a receptacle and disposed in a stand position and a lid mounted to the receptacle and disposed in an open position.
Figure 4:
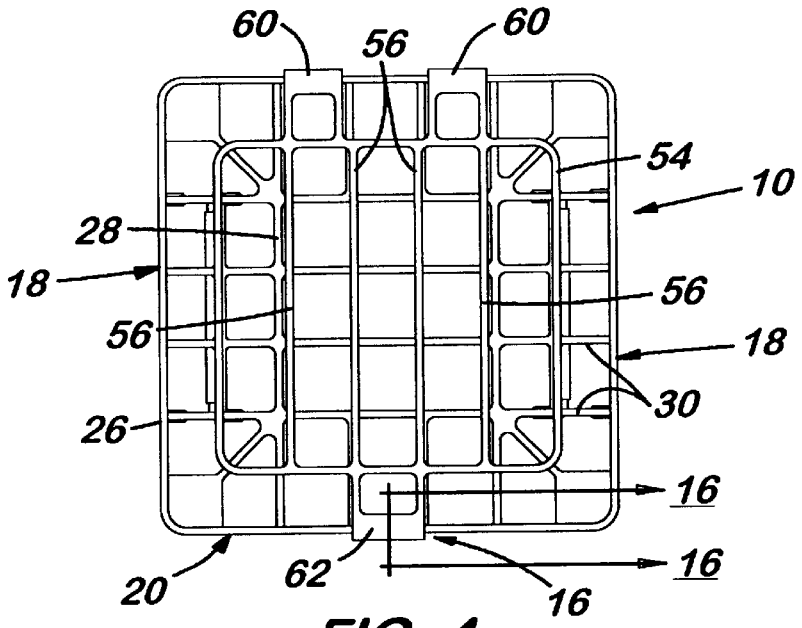
FIG. 4 is a top plan view of the retrieval and storage device as seen along line 4—4 of FIG. 3 with the support members omitted.
Figure 3:
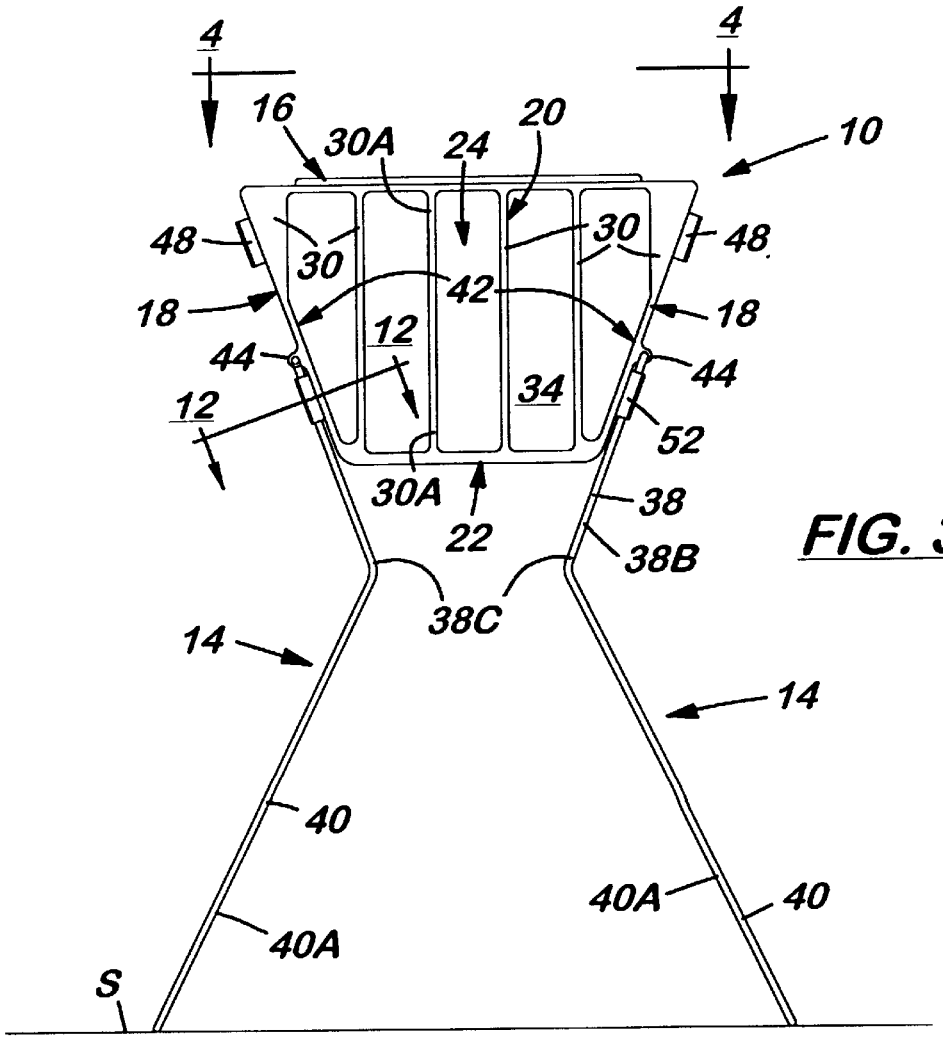
FIG. 3 is another side elevational view of the retrieval and storage device rotated ninety degrees from its position in FIG. 1 and showing the support members disposed in the stand position and the lid disposed in a closed position.
Figure 12:
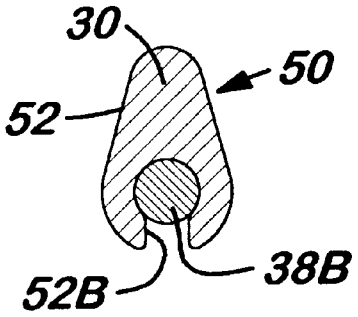
FIG. 12 is an enlarged transverse sectional view of the projection as taken along line 12—12 of FIG. 3 and similar to that of FIG. 11 but showing a portion of one of the support members received and releasably retained in a recess of the projection.
Figure 16:
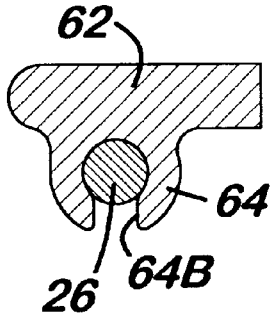
FIG. 16 is an enlarged transverse sectional view of a projection disposed on a tab of the lid with a portion of an upper annular perimeter member of the receptacle received and releasably retained in a recess of the projection as taken along line 16—16 of FIG. 4.
Figure 5:
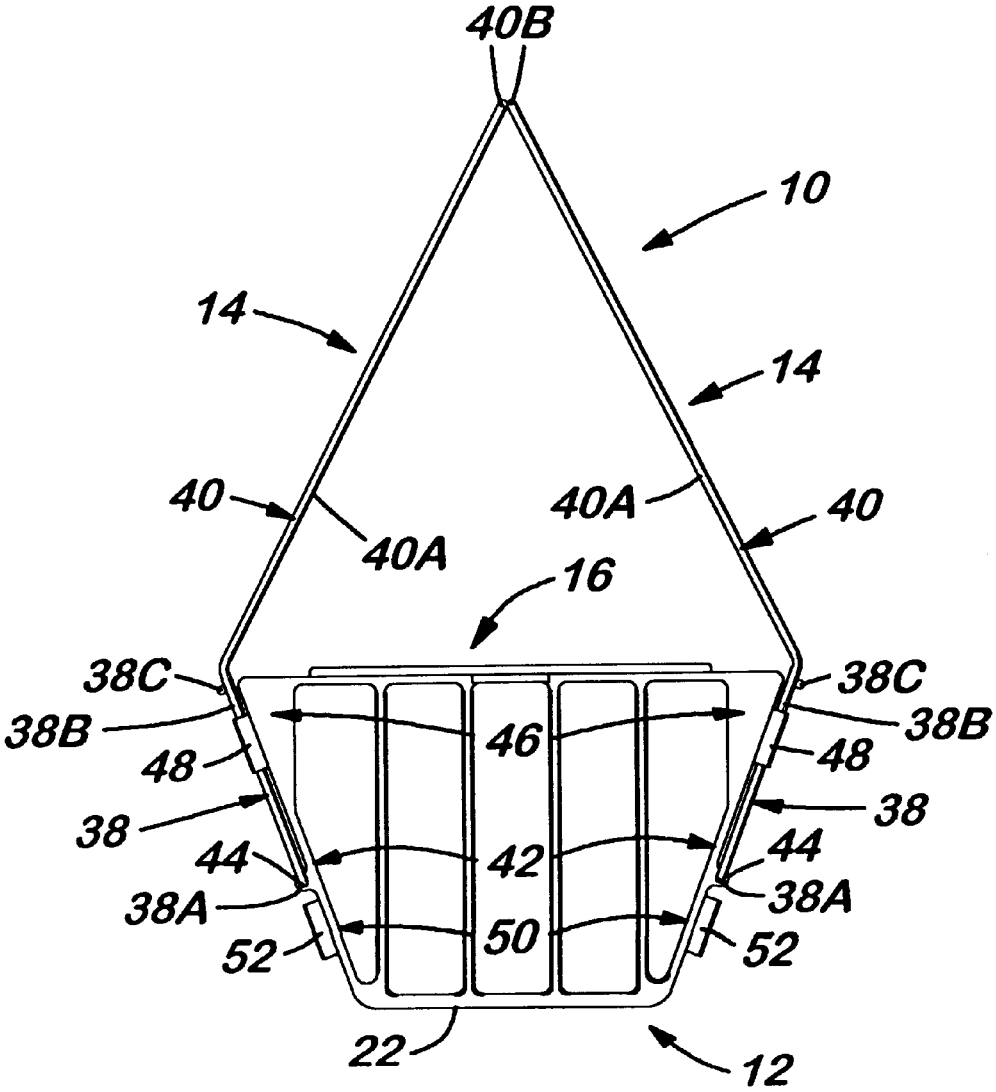
FIG. 5 is still another side elevational view of the retrieval and storage device showing the support members disposed in a handle position.

Referring to FIGS. 1, 3, 5 and 9 to 12, each of the support members 14 of the device 10 can be made of interconnected rigid wire-like bar members using suitable conventional materials and manufacturing techniques. Each support member 14 has opposite ends 14A, 14B and is pivotally mounted to one of the opposite first side walls 18 of the receptacle 12 and is pivotal relative thereto between the handle position, as shown in FIG. 5, and the stand position, as shown in FIGS. 1 and 3. The support members 14 in the handle position extend substantially above the receptacle 12 to the one ends 14A of the support members 14 now disposed adjacent to one another for a user (not shown) to hold in order to manually transport the device 10. The support members 14 in the stand position extend substantially below the receptacle 12 to the one ends 14A of the support members 14 now disposed remote from one another for resting on a support surface S for supporting the receptacle 12 at an elevated position above the support surface S.

More particularly, each support member 14 has an inner portion 38 and an outer portion 40. The outer portion 40 is angularly displaced from the inner portion 38 such that the outer portions 40 of the support members 14 converge toward one another when the support members 14 are in the handle position, as seen in FIG. 5, whereas the outer portions 40 of the support members 14 diverge from one another when the support members 14 are in the stand position, as seen in FIG. 3. The inner portion 38 of each support member 14 has opposing end sections 38A at the other ends 14B of the support members 14. The inner portion 38 has a substantially U-shaped configuration defined by a pair of opposite side sections 38B and a cross connecting section 38C. The opposing end sections 38A are attached to and extend toward one another and transversely from the ends of the opposite side sections 38A. The opposite side sections 38B are disposed substantially parallel to one another and substantially identical to one another, having substantially straight longitudinal configurations and circular cross-sectional configurations. The opposing end sections 38A have substantially straight configurations and circular cross-sectional configurations and extend along a common axis in a substantially perpendicular relation to the opposite side sections 38B. The cross connecting section 38C has a substantially straight longitudinal configuration and substantially circular cross-section configuration and extends in a substantially perpendicular relation to the opposite side sections 38B and substantially parallel relation to the opposite end sections 38A.

The outer portion 40 of each support member 14 also has a substantially U-shaped configuration. The outer portion 40 has opposite lateral sections 40A and an end section 40B. The opposite lateral sections 40A are substantially identical to one another having substantially straight longitudinal configurations and circular cross-sectional configurations. The opposite lateral sections 40A are disposed in a substantially converging relation to one another extending toward the inner portion 38 with the opposite lateral sections 40A merging with the opposite side sections 38B of the inner portion 38 adjacent to the cross connecting section 38C thereof. Each opposite lateral section 40A of the outer portion 40 is disposed at an obtuse angle in relation to the respective one side section 38B of the inner portion 38. The end section 40B of the outer portion 40 has a substantially straight longitudinal configuration and circular cross-sectional configuration. The end section 40B is connected to and disposed at an acute angle in relation to each of the opposite lateral sections 40A and is disposed in a substantially parallel relation to each of the opposing end sections 38A and the cross connecting section 38C of the inner portion 38. The opposite lateral sections 40A are disposed in a substantially diverging relation with respect to one another toward the end section 40B. The outer portion 40 has a greater length than the inner portion 38 of each support member 14. Referring now to FIGS. 1 to 4 and 10 to 15, the receptacle 12 further includes pivotal mounting means 42 for separately pivotally mounting the support members 14 to the first side walls 18 of the receptacle 12. The pivotal mounting means 42 includes a pair of projections 44 each being integrally formed as part of the molded one-piece body of the receptacle 12 and thus integrally attached on and across the elongated members 30 of one of the first side walls 18 of the receptacle 12. Each projection 44 has a substantially tubular configuration with opposite ends 44A and defining an elongated bore 44B therethrough being open at the opposite ends 44A. Each projection 44 has a length greater than the combined lengths of the opposing end sections 38A of the inner portion 38 of one of the support members 14. The bore 44B of each projection 44 is adapted to receive and retain therein the opposing end sections 38A of the inner portion 38 of the one of the support members 14 such that the opposing end sections 38A can rotate within the bore 44B upon movement of the one support member 14 relative to the receptacle 12 between the handle and stand positions.

The receptacle 12 still further includes upper securing means 46 for separately and releasably securing the support members 14 in the handle position to the first side walls 18 of the receptacle 12. The upper securing means 46 is in the form of two pairs of laterally spaced apart upper projections 48 with each pair being integrally formed as part of the molded one-piece body of the receptacle 12 and thus integrally attached on a pair of the elongated members 30 of one of the first side walls 18 thereof above the pivotal mounting means 42. Each upper projection 48 has a substantially tubular configuration with opposite ends 48A and defining an elongated recess 48B open lengthwise and at the opposite ends 48A. The upper projections 48 receive and releasably retain in a snap-fit relationship in its recess 48B respective portions of the opposite side sections 38B of the inner portion 38 of the one support member 14 when the support member 14 is placed at the handle position.

The receptacle 12 also includes lower securing means 50 for separately and releasably securing the support members 14 in the stand position to the first side walls 18 of the receptacle 12. The lower securing means 50, similar to the upper securing means 46, is in the form of two pairs of laterally spaced apart lower projections 52 with each pair being integrally formed as part of the molded one-piece body of the receptacle 12 and thus integrally attached on the pair of the elongated members 30 of one of the first side walls 18 thereof below the pivotal mounting means 42. Each lower projection 52 has a substantially tubular configuration with opposite ends 52A and defining an elongated recess 52B open lengthwise and at the opposite ends 52A. The lower projections 52 receive and releasably retain in a snap-fit relationship in their recess 52B respective portions of the opposite side sections 38B of the inner portion 38 of the one support member 14 when the support member 14 is placed at the stand position.

Referring now to FIGS. 1, 3 to 5 and 13 to 16, the lid 16 of the device 10 has a substantially rectangular shape and is in the form of a molded one-piece part made of a rigid material. The rigid material of the lid 16, like that of the receptacle 12, can be a resilient plastic or a composite of any combination of graphite, fiberglass reinforced nylon, polypropylene, PVC, ABS or polycarbonate. Also, the lid 16 can be fabricated using a suitable conventional molding technique. The lid 16 has an outer annular perimeter member 54 and laterally spaced apart elongated members 56 extending between and integrally connected at opposite ends 56A with opposite portions of the outer annular perimeter member 54. The lid 16 further has integrally formed thereon at the opposite portions of the outer annular perimeter member 54 thereof means 58 for engaging the upper annular perimeter member 26 of the receptacle 12. The engaging means 58 is in the form of a pair of laterally spaced apart first tabs 60 integrally attached on and extending outwardly from one of the opposite portions of the outer annular perimeter member 54 of the lid 16, a second tab 62 integrally attached on and extending outwardly from the other of the opposite portions of the outer annular perimeter member 54 of the lid 16, and a plurality of projections 64 each integrally formed on one of the first and second tabs 60,62. Each projection 64 has a pair of opposite ends 64A and a lengthwise open recess 64B extending between the opposite ends 64A for receiving and releasably retaining therein a respective portion of the upper annular perimeter member 26 of the receptacle 12 such that the lid 16 at the projections 64 of the first tabs 60 thereon can rotate on the open top 12A of the receptacle 12 when the projection 64 of the second tab 62 of the lid 16 is detached from the open top 12A of the receptacle 12. Thus, the lid 12 is removably and pivotally mounted to the upper annular perimeter member 26 of the receptacle 12 and can move between the open position of FIG. 1 and the closed position of FIGS. 3 and 4 relative to the open top 12A of the receptacle 12. The lid 16 in the open position is disposed away and hangs down from the open top 12A of the receptacle 12 whereas the lid 16 in the closed position is disposed across the open top 12A of the receptacle 12. Thus, with the lid 16 in the open position balls may be placed in and removed from the interior chamber 24 of the receptacle 12 whereas with the lid 16 in the closed position balls may not be placed in and removed from the interior chamber 24 of the receptacle 12.

The spaced elongated members 56 of the lid 16 define at least one and preferably a plurality of openings 66 therebetween. The presence of the openings 66 provide the lid 16 with a grate-like appearance. The width of each of the openings 66 is less than the diameter of each tennis ball disposed within the interior chamber 24 of the receptacle 12 such that none of the balls can pass through any of the openings 66 when the lid 16 is disposed in the closed position on the receptacle 12. The presence of the openings 66 reduces the amount of material used to form the lid 16 and thereby reduces the weight of the lid 16.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A sports ball retrieval and storage device, comprising:

(a) a receptacle in the form of a molded one-piece body made of a substantially rigid material and having a plurality of side walls and a bottom grate integrally connected together so as to define an open top and an interior chamber of said receptacle;

(b) said side walls and bottom grate of said molded one-piece body being formed by respective upper and lower annular perimeter members and laterally spaced apart elongated members extending between and integrally connected at opposite ends with opposite portions of said annular perimeter members;

(c) said side walls converging toward one another from said open top to said bottom grate of said receptacle and thereby providing said molded one-piece body of said receptacle with a tapered configuration permitting receptacles of multiple devices to nest with one another;

(d) said elongated members of said bottom grate being spaced apart at a distance slightly less than a diameter of a tennis ball so as to define at least one opening therebetween through which a compressed tennis ball can be forced into said interior chamber of said receptacle; and (e) a pair of support members each separately pivotally mounted to one of said side walls of an opposite pair of said side walls of said receptacle and being convertible to said receptacle between a stand position and a handle position;

(f) said receptacle further including upper means integrally formed on each side wall of said opposite pair of side walls of said receptacle for releasably securing each of said support members in said handle position, said upper securing means including two pairs of laterally spaced apart upper projections, each of said pairs of upper projections being integrally formed as part of said molded one-piece body of said receptacle on one side wall of said opposite pair of said side walls of said receptacle, each of said upper projections being of a substantially tubular configuration and having opposite ends and defining a recess open lengthwise between said opposite ends for receiving and releasably retaining therein a section of one of said support members when said one support member is moved in a direction substantially perpendicular to said one side wall and aligned with said recess from said stand position to said handle position.

2. The device as recited in claim 1, wherein said support members in said handle position extend substantially above said receptacle to ends of said support members disposed adjacent to one another for a user to hold in manually transporting said device.

3. The device as recited in claim 2, wherein each of said support members has an inner portion and an outer portion, said outer portion being angularly displaced from said inner portion such that said outer portions of said support members converge toward one another when said support members are in said handle position.

4. The device as recited in claim 1, wherein:

each of said support members has an inner portion and an outer portion, said inner portion has opposing end sections; and said receptacle has means integrally formed on each of said side walls of said opposite pair of said side walls of said receptacle for pivotally mounting each of said support members to said receptacle.

5. The device as recited in claim 4, wherein said pivotal mounting means includes a pair of projections each being integrally formed as part of said molded one-piece body of said receptacle on one of said side walls of said opposite pair of said side walls of said receptacle, each of said projections having opposite ends and defining a bore open at said opposite ends, said bore and said opposite ends of each projection being adapted to receive and retain therein said opposing end sections of said inner portion of one of said support members such that said opposing end sections of said inner portion of said one support member can rotate within said bore upon movement of said one support member between said handle and stand positions.

6. A sports ball retrieval and storage device, comprising:

(a) a receptacle in the form of a molded one-piece body made of a substantially rigid material and having a plurality of side walls and a bottom grate integrally connected together so as to define an open top and an interior chamber of said receptacle;

(b) said side walls and bottom grate of said molded one-piece body being formed by respective upper and lower annular perimeter members and laterally spaced apart elongated members extending between and integrally connected at opposite ends with opposite portions of said annular perimeter members;

(c) said side walls converging toward one another from said open top to said bottom grate of said receptacle and thereby providing said molded one-piece body of said receptacle with a tapered configuration permitting receptacles of multiple devices to nest with one another;

(d) said elongated members of said bottom grate being spaced apart at a distance slightly less than a diameter of a tennis ball so as to define at least one opening therebetween through which a compressed tennis ball can be forced into said interior chamber of said receptacle; and (e) a lid mounted to said receptacle for opening and closing said open top of said receptacle, said lid being in the form of a molded one-piece part made of a plastic material and having an outer annular perimeter member and laterally spaced apart elongated members extending between and integrally connected at opposite ends with opposite portions of said outer annular perimeter member, said lid having integrally formed thereon at said opposite portions of said outer annular perimeter member thereof means for engaging and connecting said lid to said upper annular perimeter member of said receptacle, said engaging and connecting means including:

a pair of laterally spaced apart first tabs integrally attached on and extending outwardly from one of said opposite portions of said outer annular perimeter member of said lid;

a second tab integrally attached on and extending outwardly from the other of said opposite portions of said outer annular perimeter member of said lid; and a plurality of projections each integrally formed on one of said first and second tabs, each of said projections having a pair of opposite ends and a lengthwise open recess extending between said opposite ends for receiving and releasably retaining therein a respective portion of said upper annular perimeter member of said receptacle such that said lid at said projections of said first tabs can pivot relative to said open top of said receptacle between an open position and a closed position when said projection of said second tab of said lid is detached from said open top of said receptacle.

7. The device as recited in claim 6, wherein said lid is removably and pivotally mounted to said upper annular perimeter member of said side walls of said receptacle.

8. The device as recited in claim 6, further comprising:

a pair of support members each separately pivotally mounted to one of said side walls of an opposite pair of said side walls of said receptacle and being convertible relative to said receptacle between a stand position and a handle position.

9. The device as recited in claim 8, wherein said support members in said handle position extend substantially above said receptacle to ends of said support members being disposed adjacent to one another for a user to hold in manually transporting said device.

10. The device as recited in claim 8, wherein said support members in said stand position extend substantially below the receptacle to ends of said support members being disposed remote from one another for resting on a support surface to support said receptacle at an elevated position above the surface.

11. A sports ball retrieval and storage device, comprising:

(a) a receptacle in the form of a molded one-piece body made of a substantially rigid material and having a plurality of side walls and a bottom grate integrally connected together so as to define an open top and an interior chamber of said receptacle;

(b) said side walls and bottom grate of said molded one-piece body being formed by respective upper and lower annular perimeter members and laterally spaced apart elongated members extending between and integrally connected at opposite ends with opposite portions of said annular perimeter members;

(c) said side walls converging toward one another from said open top to said bottom grate of said receptacle and thereby providing said molded one-piece body of said receptacle with a tapered configuration permitting receptacles of multiple devices to nest with one another;

(d) said elongated members of said bottom grate being spaced apart at a distance slightly less than a diameter of a tennis ball so as to define at least one opening therebetween through which a compressed tennis ball can be forced into said interior chamber of said receptacle; and (e) a pair of support members each separately pivotally mounted to one of said side walls of an opposite pair of said side walls of said receptacle and being convertible to said receptacle between a stand position and a handle position;

(f) said receptacle further including lower means integrally formed on each side wall of said opposite pair of side walls of said receptacle for releasably securing each of said support members in said stand position, said lower securing means including two pairs of laterally spaced apart lower projections, each of said pairs of lower projections being integrally formed as part of said molded one-piece body of said receptacle on one side wall of said opposite pair of said side walls of said receptacle, each of said lower projections being of a substantially tubular configuration and having opposite ends and defining a recess open lengthwise between said opposite ends for receiving and releasably retaining therein a section of one of said support members when said one support member is moved in a direction substantially perpendicular to said one side wall and aligned with said recess from said handle position to said stand position.

12. The device as recited in claim 11, wherein said support members in said stand position extend substantially below the receptacle to ends of said support members disposed remote from one another for resting on a support surface to support said receptacle at an elevated position above the surface.

13. The device as recited in claim 12, wherein each of said support members has an inner portion and an outer portion, said outer portion being angularly displaced from said inner portion such that said outer portions diverge from one another when said support members are in the stand position.

14. The device as recited in claim 11, wherein:

each of said support members has an inner portion and an outer portion, said inner portion has opposing end sections; and said receptacle has means integrally formed on each of said side walls of said opposite pair of said side walls of said receptacle for pivotally mounting each of said support members to said receptacle.

15. The device as recited in claim 14, wherein said pivotal mounting means includes a pair of projections each being integrally formed as part of said molded one-piece body of said receptacle on one of said side walls of said opposite pair of said side walls of said receptacle, each of said projections having opposite ends and defining a bore open at said opposite ends, said bore and said opposite ends of each projection being adapted to receive and retain therein said opposing end sections of said inner portion of one of said support members such that said opposing end sections of said inner portion of said one support member can rotate within said bore upon movement of said one support member between said handle and stand positions.

* * * * *